United States Patent [19]

Wilson

[11] 4,352,338

[45] Oct. 5, 1982

[54] PULPIT

[76] Inventor: Gerald H. Wilson, 1712 SW. 24th St., Ft. Lauderdale, Fla. 33315

[21] Appl. No.: 182,807

[22] Filed: Aug. 29, 1980

[51] Int. Cl.[3] ..... B63B 17/00; B63B 17/04

[52] U.S. Cl. ..... 114/364; 114/255; 248/240.4

[58] Field of Search ..... 9/1.7, 1.1; 182/112, 182/113; 248/240, 240.3, 240.4, 293; 285/155; 5/81 R, 425, 429; 52/DIG. 10

[56] References Cited

U.S. PATENT DOCUMENTS

| | | | |
|---|---|---|---|
| 335,265 | 2/1886 | Winnans | 248/240.4 |
| 786,911 | 4/1905 | Miles et al. | 285/155 |
| 2,905,126 | 9/1959 | Gaffey | 9/1.7 |
| 3,595,510 | 7/1971 | Hutchinson | 182/113 |

OTHER PUBLICATIONS

Egg Harbour Boat Company, Advertisement, *Boating,* vol. 44, No, 4, (Oct. 78), p. 128.

*Primary Examiner*—Trygve M. Blix
*Assistant Examiner*—Harry A. Smith
*Attorney, Agent, or Firm*—Malin & Haley

[57] ABSTRACT

A knock-down pulpit for a boat comprising a first brace connectable to the front deck of a boat, a body support platform, a frame for holding the body support platform which is connected to the first brace, a railing connected to the frame, a second brace connected to the bow of the boat and a support structure having one end connected to the second brace and the opposite end connected to the frame. The pulpit is designed such that the components may be compactly packaged at the factory for easy shipment, and then installed at the location of the boat with minimal effort. Once installed, the pulpit extends from the front deck of the boat past the bow.

4 Claims, 4 Drawing Figures

PULPIT

The present invention relates to pulpits for boats and more particularly to a knock-down pulpit with many components which may be compacted and packaged at the factory for easy shipment.

BACKGROUND ART

In the past, there have been various pulpits designed for boats. By way of example, is U.S. Pat. No. 2,905,126 which illustrates a pulpit for a boat. The pulpit comprises a curved forward section, two side sections, two upwardly extending braces, a T-coupling means connecting each end of the forward section to one end of the side section and to one end of one of the braces, each of the T-coupling means comprising three swivel arms two of which are axially aligned, the third of the arms mounting its respective brace rotatively around the axis on one end of the brace. However, this pulpit is designed to be connected directly to the forward deck of the boat and does not serve as an extension thereto.

The present invention provides a knock-down pulpit whose components make the pulpit connectable to extend beyond the deck and bow of the boat. The components are such that they may be compactly packaged at the factory for easy shipment, and then installed at the location of the boat with minimal effort. The curvature of the frame for holding the body platform is not dependent upon the shape of the front deck where it meets the bow and therefore the knock-down pulpit is attachable to any type boat.

DISCLOSURE OF INVENTION

A knock-down pulpit for a boat comprising a first brace, a body support platform, a frame for holding the body support platform, a second brace, and a support structure.

The first brace is connected to the boat near the front deck of the boat where it meets the bow. One end of the frame is then connected to the first brace and extends beyond the front of the boat. The frame is designed to support a body support platform and also includes a railing structure projecting upwardly therefrom in order to allow the user to balance himself on the platform.

A second brace is fixed to the bow of the boat a predetermined distance below the first brace. Once the second brace is in place a support structure has one end connected to the second brace and the opposite end connected to the frame. The support structure also can include an additional member connected between the support structure and the frame to provide additional support to the frame.

The knock-down pulpit is especially designed so that each component may be compactly packaged at the factory for easy shipment, sold unassembled, and then installed on the boat at any convenient location.

It is therefore an object of this invention to provide a knock-down pulpit of many components which can be compactly packaged at the factory for easy shipment.

It is another object of this invention to provide a knock-down pulpit which can be connected to any boat regardless of the shape of the front deck and bow.

In accordance with these and other objects which will be apparent hereinafter, the instant invention will now be described with particular reference to the accompanying drawings.

BEST MODE FOR CARRYING OUT THE INVENTION

Figure 1:
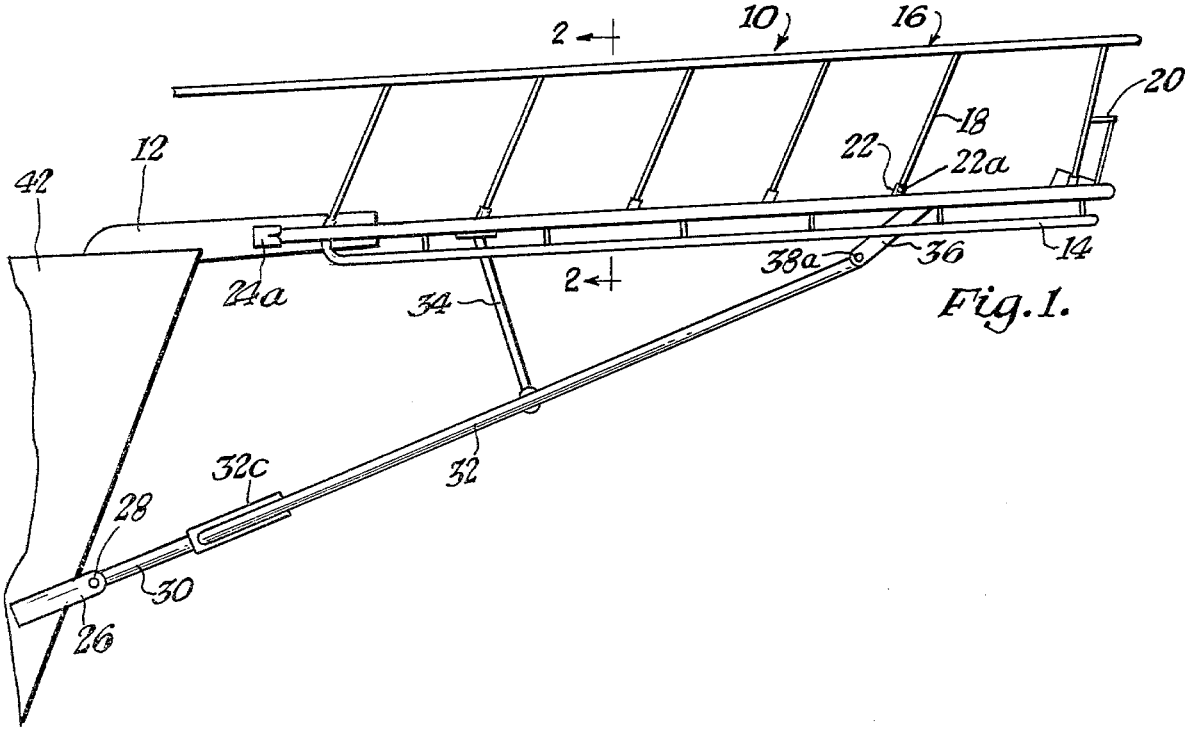
FIG. 1 is a side view of the pulpit connected to the bow of a boat.

Referring now to the drawings and more particularly to FIG. 1, the knock-down pulpit is shown in an assembled form and designated by numeral 10. The pulpit 10 includes a first brace 12 which is connected to the front deck of the boat 42 near the bow, a frame 14 which is connected to the brackets **24*a* and 24*b* on the first brace 12, support structure 32 having one end connected to a second brace 26 which is fixed to the bow of the boat 42 below the first brace 12, and the end connected to a brace 36 which is connected to the frontal portion of the frame 14. An additional brace 34 can be added which is connected to the support structure 32 at its approximate mid-point and having the other end connected to the frame 14 near the rear portion of the frame. Railing 16 has a plurality of struts 18 which fit into a plurality of respective sockets 22 secured in place by set screws 22*a*. The front strut 20 of the railing is designed to follow the contour of the front of the frame 14** to allow the user to stand on the very end of the pulpit.

Figure 2:
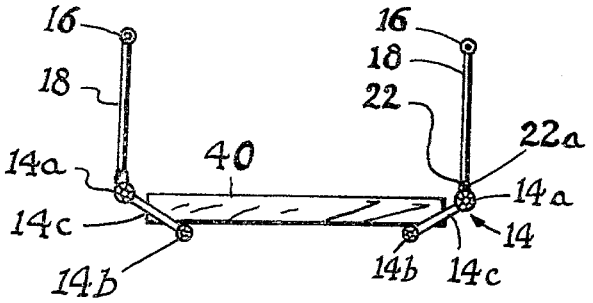
FIG. 2 is a cross-sectional view of the invention taken across the lines 2—2 and looking in the direction of the arrows.
Figure 3:
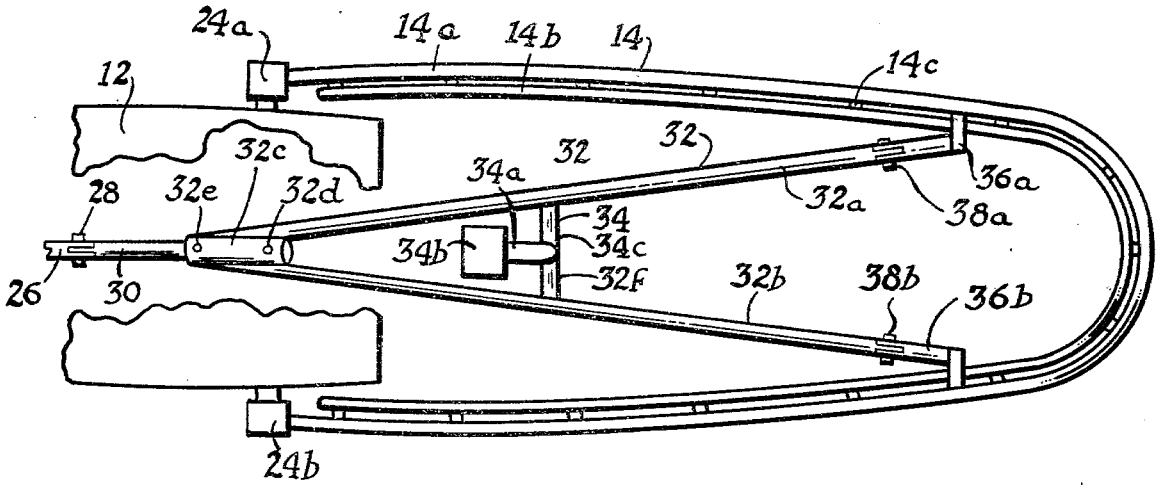
FIG. 3 is a top view of the pulpit shown in FIG. 1.

Now referring to FIG. 2 a cross-section of the portion of the pulpit 10 is shown. As can be seen the frame 14 includes an upper tubular member **14*a* and a lower tubular member 14*b* of lesser diameter than the upper tubular member 14*a* connected together by a plurality of connecting members 14*c*. The lower tubular member 14*b* is positioned inward of the upward tubular member 14*a* for the full U-shaped contour of the frame in order that a body support platform 40 may rest thereupon. The tubular railing 16 is connected to a plurality of side members 18 which have their free ends connected in a plurality of sockets 22 which are fixed to the tubular member 14*a*, the side members 18 being held in place by the set screws 22*a***.

Referring now to FIG. 2 the details of the support structure 32 are more particularly pointed out. The V-shaped support structure 32 includes a first support member **32*a* and a second support member 32*b* having their respective spaced apart ends connected to the respective brackets 36*a* and 36*b* and having their opposite ends connected to a tubular connecting member 32*c*. The tubular connecting bracket 32*c* is in turn fitted over the second tubular member 30 which is of lesser diameter than the first tubular member 32*c* and maintains its fixed position by way of screws 32*d* and 32*e*. The opposite end of the tubular member 30 is pivotally connected to the second brace 26 by way of the pin 28**.

The additional supporting brace 34 has a respective end of a T-bracket portion **34*c* fitting over a respective cylindrical knob 32*f* and 32*g* of the support structure 32, a straight strut member 34*a* connected to T-bracket 34 and having the other end fixed to the connecting bracket 34*b* which connects the additional support strut 34 to the body support platform 40**.

Figure 4:
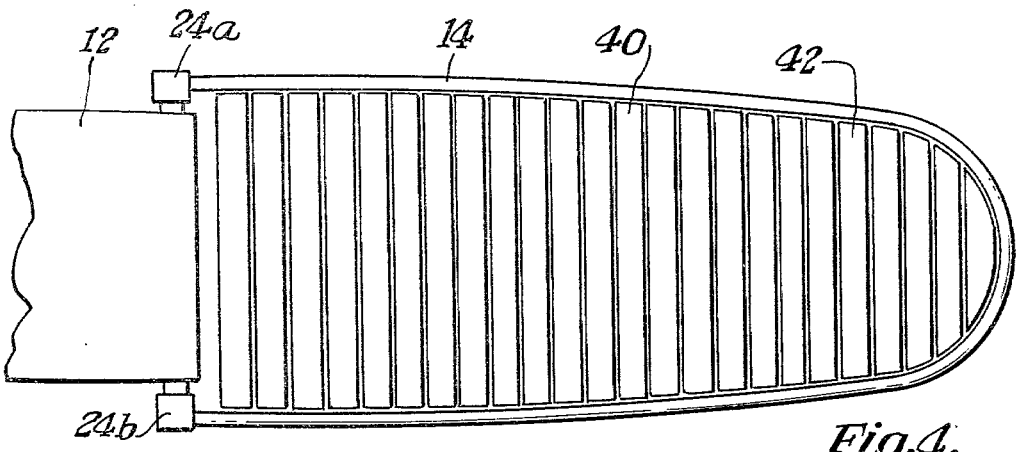
FIG. 4 is a top view of the pulpit shown in FIG. 1 illustrating the body support platform.

As shown in FIG. 4 the body platform is constructed of a plurality of spaced apart slats 42 in side by side relationship.

The instant invention has been shown and described herein in what is considered to be the most practical and preferred embodiment. It is recognized, however, that departures may be made therefrom within the scope of the invention and that obvious modifications will occur to a person skilled in the art.

INDUSTRIAL APPLICABILITY

The knock-down pulpit can be sold commercially in unassembled form for installation on boats.

I claim:

1. A knock-down pulpit for a boat, comprising: a first brace connectable to the forward deck of the boat; a body support platform; a frame means for supporting said body support platform, said frame means removably connected to said first brace; a rail projecting upwardly from said frame means; means for removably connecting said rail to said frame means; a second brace connectable to the bow of the boat; a support means having one end removably connected to said second brace and the other end removably connected to said frame means, said frame means includes a first upper elongated U-shaped, and a second lower elongated U-shaped tubular member of lesser diameter than said first upper tubular member connected to said upper tubular member, said rail includes a third, elongated U-shaped tubular member with a plurality of support struts extending downwardly therefrom; and said means for connecting said rail to said frame means includes a plurality of rail sockets connected to said frame means; said rail sockets engaged with the free ends of said support struts; means for securing said support struts within said rail sockets.

2. A knock-down pulpit for a boat, comprising: a first brace connectable to the forward deck of the boat; a body support platform; a frame means for supporting said body support platform, said frame means removably connected to said first brace; a rail projecting upwardly from said frame means; means for removably connecting said rail to said frame means; a second brace connectable to the bow of the boat; a support means having one end removably connected to said second brace and the other end removably connected to said frame means, said frame means includes a first upper elongated U-shaped, tubular member; and a second lower elongated U-shaped, tubular member of lesser diameter than said upper tubular member connected to said upper tubular member.

3. A knock-down pulpit for a boat, comprising: a first brace connectable to the forward deck of the boat; a body support platform; a frame means for supporting said body support platform, said frame means removably connected to said first brace; a rail projecting upwardly from said frame means; means for removably connecting said rail to said frame means; a second brace connectable to the bow of the boat; a support means having one end removably connected to said second brace and the other end removably connected to said frame means, said frame means includes a first upper elongated U-shaped, tubular member of lesser diameter than said upper tubular member connected to said upper tubular member, said rail includes a third, elongated U-shaped tubular member with a plurality of support struts extending downwardly therefrom; and said means for connecting said rail to said frame means includes a plurality of rail sockets connected to said frame means; said rail sockets engaged with the free ends of said support struts; means for securing said support struts within said rail sockets, said support means includes a fourth tubular member; a fifth elongated V-shaped tubular member having the singular end sized for mating with said fourth tubular member and a dual member opposite end to the dual member spaced for connecting to said frame means; said fourth tubular member connected to said singular end and sized for connecting to said second brace.

4. A collapsible pulpit for a boat as set forth in claim 3, wherein: said fifth tubular member further includes a pair of coaxially aligned support means sockets, a T-coupling member, said T-coupling member mounted in said pair of support means sockets; a sixth tubular member, having one end connected to said T-coupling member and the opposite end connected to said frame means.

* * * * *